US008490225B2

(12) United States Patent
Saxby

(10) Patent No.: US 8,490,225 B2
(45) Date of Patent: Jul. 23, 2013

(54) SANITARY UNIT COMPRISING A TOILET AND A WASH BASIN BOTH SLIDABLY MOUNTED

(75) Inventor: Michael Saxby, Oxford (GB)

(73) Assignee: Michael Saxby (GB)

( * ) Notice: Subject to any disclaimer, the term of this patent is extended or adjusted under 35 U.S.C. 154(b) by 0 days.

(21) Appl. No.: 13/383,184

(22) PCT Filed: Jul. 12, 2010

(86) PCT No.: PCT/GB2010/001326

§ 371 (c)(1),
(2), (4) Date: Mar. 19, 2012

(87) PCT Pub. No.: WO2011/004167

PCT Pub. Date: Jan. 13, 2011

(65) Prior Publication Data

US 2012/0159704 A1 Jun. 28, 2012

(30) Foreign Application Priority Data

Jul. 10, 2009 (GB) ..... 0912075.9

(51) Int. Cl.
*A47K 17/00* (2006.01)

(52) U.S. Cl.
USPC ..... 4/661

(58) Field of Classification Search
USPC ..... 4/663, 619–660
See application file for complete search history.

(56) References Cited

FOREIGN PATENT DOCUMENTS

| | | | |
|---|---|---|---|
| EP | 0 074 934 | A2 | 3/1983 |
| EP | 0074934 | * | 3/1983 |
| FR | 1 377 197 | A | 10/1964 |
| FR | 1377197 | * | 10/1964 |
| FR | 2 297 960 | A1 | 8/1976 |
| FR | 2297960 | * | 8/1976 |
| FR | 2 323 831 | A1 | 4/1977 |
| FR | 2323831 | * | 4/1977 |
| FR | 2 346 507 | A1 | 10/1977 |
| FR | 2346507 | * | 10/1977 |
| GB | 1 127 314 | A | 9/1968 |
| GB | 1127314 | * | 9/1968 |
| WO | WO03/074800 | * | 9/2003 |
| WO | WO 03/074800 | A1 | 9/2003 |

OTHER PUBLICATIONS

International Search Report for International Application No. PCT/GB2010/001326, mailing date Oct. 1, 2010, 4 pages.

* cited by examiner

*Primary Examiner* — Lori Baker
(74) *Attorney, Agent, or Firm* — McDonnell Boehnen Hulbert & Berghoff

(57) ABSTRACT

A sanitary unit comprises a toilet having a bowl (3) provided with a seat (4), and a wash basin (12) supported above the toilet bowl. The wash basin is mounted for sliding movement between a retracted position in which there is access to the toilet bowl, and a forward position in which the wash basin is to be used. The toilet bowl is mounted for simultaneous sliding movement between a retracted position and a forward position in which the toilet bowl is to be used, under the action of a mechanism (56) which interconnects the toilet bowl and the basin.

10 Claims, 5 Drawing Sheets

SANITARY UNIT COMPRISING A TOILET AND A WASH BASIN BOTH SLIDABLY MOUNTED

CROSS REFERENCE TO RELATED APPLICATIONS

The present application is a national stage entry of PCT/GB2010/001326, filed Jul. 12, 2010, and claims priority to GB 0912075.9, filed Jul. 10, 2009. The full disclosures of GB 0912075.9 and PCT/GB2010/001326 are incorporated herein by reference.

This invention relates to a sanitary unit including a toilet and a wash basin.

In this specification, the expression "toilet" refers to a bowl provided with a portion on which a user may sit, used for defecation and urination. The bowl is connectable to a flushing device for flushing the bowl with water. Typically the flushing device may include a cistern or similar waste water prevention device, although there are alternative arrangements for controlling the admission of water into the bowl for flushing purposes.

There are a number of occasions in which the space available for a toilet and a wash basin is limited. Compact wash basins are available for use in confined spaces, but these may be too small for general use and are intended only for hand washing after use of the toilet. They may still obstruct access to a toilet to a certain extent. It has been proposed to incorporate a wash basin in the upper surface of a low level cistern. Such basins are compromised in terms of size and ease of use, and again are intended for hand washing after use of the toilet. In any event, people may not consider a wash basin in the lid of a cistern to be suitable for general use and some people may consider it inconvenient or unpleasant to lean over a lavatory bowl to reach the basin, even if the bowl is provided with a lid.

Where there is sufficient space to the side of a toilet, it has been proposed to have a wash basin supported over the bowl of the toilet. When the toilet needs to be used, the wash basin is slid or pivoted to the side to provide access to the toilet. Such arrangements have been proposed for sleeping berths on trains, ships and so forth. The wash basin may be moved into a space reserved for a shower. An advantage of such arrangement is that it is not necessary to lean fully over the toilet bowl, but the bowl can still be obstructive and in any event the arrangement is unsuitable unless there is sufficient lateral free space for the basin to move in to.

One object of the present invention is to provide an alternative arrangement for a sanitary unit comprising a toilet and was basin, which provides good access to both. Viewed from one aspect, the present provides a sanitary unit comprising a toilet having a bowl provided with a seat portion, the toilet bowl having a front and a rear, and a wash basin supported at a level higher than that of the toilet bowl, the wash basin being mounted for sliding movement horizontally, parallel to a line extending through the front and rear of the toilet bowl, between a retracted position in which there is access to the toilet bowl, and a forward position in which the wash basin is to be used.

In the retracted position the wash basin may be positioned rearwardly of a rear part of the toilet bowl, so that there is unimpeded access to the toilet bowl and so that a user may sit comfortably on the seat portion of the toilet bowl. In the forward position of the wash basin, the basin will be readily accessible but access to the toilet bowl may be impeded or prevented.

In general, the optimum position for use of the wash basin would be forward of, or at least close to, the front of the toilet bowl so that the bowl does not impede a user moving as close to the front of the wash basin as they might wish. The arrangement may be such that the toilet bowl remains stationary and only the wash basin moves. However, this means that there must be a sufficient distance of movement of the wash basin into the optimum position for use. In a preferred arrangement, therefore, both the toilet bowl and the wash basin may be moved between a retracted position and a position for normal use. Thus, in some embodiments the toilet bowl is mounted for sliding movement horizontally, parallel to the line extending through the front and rear of the toilet bowl, between a retracted position and a forward position in which the toilet bowl is to be used.

Preferably, forwards movement of the wash basin is accompanied by rearwards movement of the toilet bowl; and correspondingly, rearwards movement of the wash basin is accompanied by forwards movement of the toilet bowl. In such an arrangement, less movement of the washbasin is required to take it between its retracted and forward positions, because the toilet bowl moves simultaneously in the opposite direction, preferably by a corresponding amount. Thus, in some embodiments the wash basin and the toilet bowl are inter-linked such that movement of the wash basin away from its retracted position is accompanied automatically by movement of the toilet bowl towards its retracted position, and such that movement of the wash basin towards its retracted position is accompanied automatically by movement of the toilet bowl away from its retracted position. It will be appreciated that where it is stated that movement of one component is accompanied by movement of the other component, this does not mean that the one component is that to which direct manual force is applied to effect movement of the two components. For example, the basin can be pulled whilst the toilet bowl retracts automatically under the action of a mechanism, or the toilet bowl can be pushed whilst the wash basin is extended automatically by a mechanism. It may be that only one of the components has direct manual force applied to it, for both directions of movement. Thus, for example, a user may need only to push or pull the one component between its retracted and extended positions, whilst the other component moves automatically in response to this.

In any event, in some embodiments both the toilet bowl and the wash basin are mounted for sliding movement horizontally, parallel to a line extending through the front and rear of the toilet bowl, between retracted and forward positions. When the wash basin is in its retracted position, the toilet bowl will be in its forward position, and when the wash basin is in its forward position, the toilet bowl will be in its retracted position. Preferably, there are provided interconnecting means between the toilet bowl and the wash basin, so that movement of one is accompanied by movement of the other. Thus, as the wash basin moves forwards, the toilet bowl will retract simultaneously. Similarly, as the wash basin is retracted, the toilet bowl will move forwards automatically. The arrangement could be such that a user can move either of the items manually, and the other will move automatically. The arrangement could be such that a user pulls the wash basin out and the toilet bowl is retracted automatically, and/or that the user pushes the toilet bowl back and the wash basin moves forwards automatically. The arrangement could be such that a user pushes the wash basin back and the toilet bowl moves forwards automatically, and/or that the user pulls the toilet bowl forwards and the wash basin is retracted automatically.

In some preferred arrangements, all operations can be carried out by movement of the wash basin, as some users may not wish to make use the toilet bowl as the operating item. A handle could be used to pull and push the wash basin.

An alternative arrangement would be to provide a separate operating mechanism, such as an operating lever, so that movement of the wash basin and toilet bowl does not involve manipulating either manually. It would be possible to have a mechanism that is operated hydraulically, pneumatically or electrically, so that a user only need to press a button or other control element, for example, for the items to move.

The arrangement may be such that as the wash basin moves out to its operative position, the toilet is flushed automatically. Thus a person can use the toilet, and then in a single operation—for example by pulling the wash basin or pushing a button, retract the toilet, flush the toilet and move the wash basin into position for hand washing.

A linkage between the wash basin and the toilet bowl could include pivoted rod(s), and/or gear wheels, and or one or more drive chains, and/or one or more toothed belts. The linkage could be a lever mounted pivotally, and connected at either end to the wash basin and the toilet bowl. There could be a pneumatic, hydraulic or electric circuit. For example, servo motors, linear actuators or other electrical driving elements could effect movement of any components. As noted above there could be a totally automatic arrangement in which a user presses a button or the like and the wash basin and toilet bowl move automatically. Alternatively, movement of one—such as the wash basin—could serve as a switch so that the other will move. Hydraulic or pneumatic circuits could be operated in a similar way, under the action of an electric pump. Alternatively, movement of one component could be used to generate enough hydraulic or pneumatic pressure to move the other component.

Latching means may be provided so that when the wash basin is in its forward position, rearwards movement is resisted so that the basin does not move back accidentally whilst being used, and/or so that when the toilet bowl is in its forward position, rearwards movement is resisted so that the toilet bowl does not move back accidentally whilst being used.

Preferably water supply pipe(s) to the wash basin (hot and/or cold water) and a waste pipe from the wash basin are flexible, at least in part. In some embodiments, there may be no need for water supply pipes to the wash basin, as there may be a fixed tap or taps, under which the wash basin is positioned when in its forward position. Preferably a water supply pipe to the toilet bowl (from a cistern or other source) and a waste pipe from the toilet bowl are flexible, at least in part. In general, only the toilet bowl, its immediate accessories such as seat and cover, and a waste pipe portion will move, whereas the cistern would be separate and fixed in position. However, it would be possible for the toilet bowl to be part of an integrated system including a cistern.

Viewed from another aspect, the invention provides a sanitary unit comprising a toilet having a bowl provided with a seat portion, the toilet bowl having a front and a rear, and a wash basin supported at a level higher than that of the toilet bowl, there being a vertical plane which passes though the front and rear of the toilet bowl and which also passes through the wash basin, the wash basin being mounted for sliding movement horizontally, parallel to a horizontal line lying in said vertical plane, between a retracted position in which there is access to the toilet bowl, and a forward position in which the wash basin is to be used. In some embodiments of this aspect of the invention, the toilet bowl is mounted for sliding movement horizontally, along said horizontal line, between a retracted position and a forward position in which the toilet bowl is to be used. In such an arrangement, a linkage may interconnect the wash basin and the toilet bowl such that movement of one of the wash basin and the toilet bowl away from its retracted position is accompanied automatically by movement of the other of the wash basin and the toilet bowl towards its retracted position.

It would be possible to have an arrangement in which only the toilet bowl moves. Thus, viewed from another aspect, the invention provides a sanitary unit comprising a toilet having a bowl provided with a seat portion, the toilet bowl having a front and a rear, and a wash basin supported at a level higher than that of the toilet bowl, there being a vertical plane which passes though the front and rear of the toilet bowl and which also passes through the wash basin, the toilet bowl being mounted for sliding movement horizontally along horizontal line lying in said vertical plane, between a retracted position underneath the wash basin and a forward position in which there is access to the toilet bowl.

Some embodiments of the invention will now be described by way of example and with reference to the accompanying drawings, in which.

Figure 1:
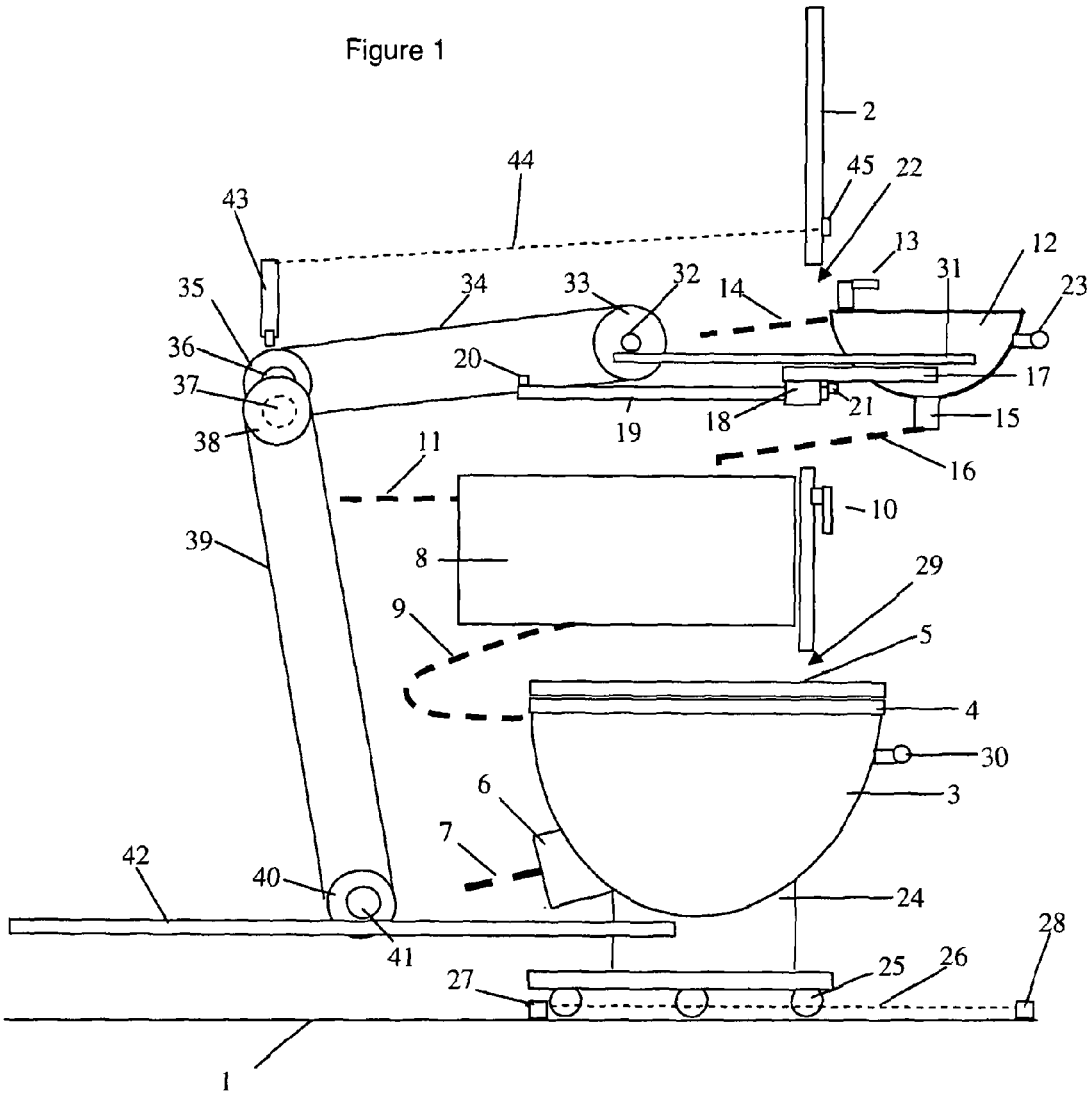
FIG. 1 is a diagrammatic side view of a sanitary installation in accordance with the invention, with the wash basin extended.

As shown in FIG. 1, a water closet has a floor 1 and a partition wall 2. Provided in the water closet is a toilet having a bowl 3 with a seat 4 and a lid 5. The bowl has an outlet 6 connected by a flexible pipe indicated schematically at 7 to a soil pipe (not shown). The bowl 3 is connected to a cistern 8 by means of a flexible water pipe indicated schematically at 9. The cistern is operated by a handle 10 mounted on the wall 2. The cistern 8 is connected to water supply by means of a pipe 11. As shown, the toilet bowl 3 is in a retracted, non-operative position.

Above the toilet bowl 3 is a wash basin 12. This provided with a water tap 13 connected to a water supply by a flexible pipe indicated schematically at 14. The wash basin is provided with a waste outlet 15. The waste outlet is connected to a flexible waste pipe indicated schematically at 16, which feeds waste water from the basin 12 to the cistern 8 so that the waste water from basin 12 can be recycled to flush the toilet bowl 3. The wash basin is provided, on each side, with a mounting bracket 17 connected to a slider 18 mounted on a slide bar 19 provided with rear and front stops 20 and 21 respectively. The wash basin can therefore be retracted and extended through an opening 22 in the wall 2. A handle 23 is provided on the wash basin so that it can be pushed and pulled into the desired position.

The toilet bowl 3 is mounted on a base 24, which in turn is provided—on either side—with rollers 25 that are engaged in a track 26 provided with end stops 27 and 28. The toilet bowl 3 can therefore be retracted and moved out into an operative condition, through an opening 29 in the wall 2. A handle 30 is provided on the front of the toilet bowl so that it can be pushed and pulled into the desired position.

A mechanism is provided so that movement of one of the toilet bowl and wash basin, will simultaneously cause movement of the other. Thus, the wash basin 12 is secured to an operating arm 31 on which is provided a rack. This is engaged with a pinion 32, which is mounted for rotation with a toothed wheel 33. This is engaged with a toothed belt 34 which passes round a second toothed wheel 35. This second toothed wheel 35 is mounted for rotation with a second pinion 36, which in turn is engaged with a third pinion 37 mounted for rotation with a third toothed wheel 38. A second toothed belt 39 passes around the third toothed wheel 38 and passes round a fourth toothed wheel 40. A pinion 41 is mounted for rotation with fourth toothed reel 40, and is engaged with a second rack 42 which is secured to the base 24 for the toilet bowl 3.

Figure 2:
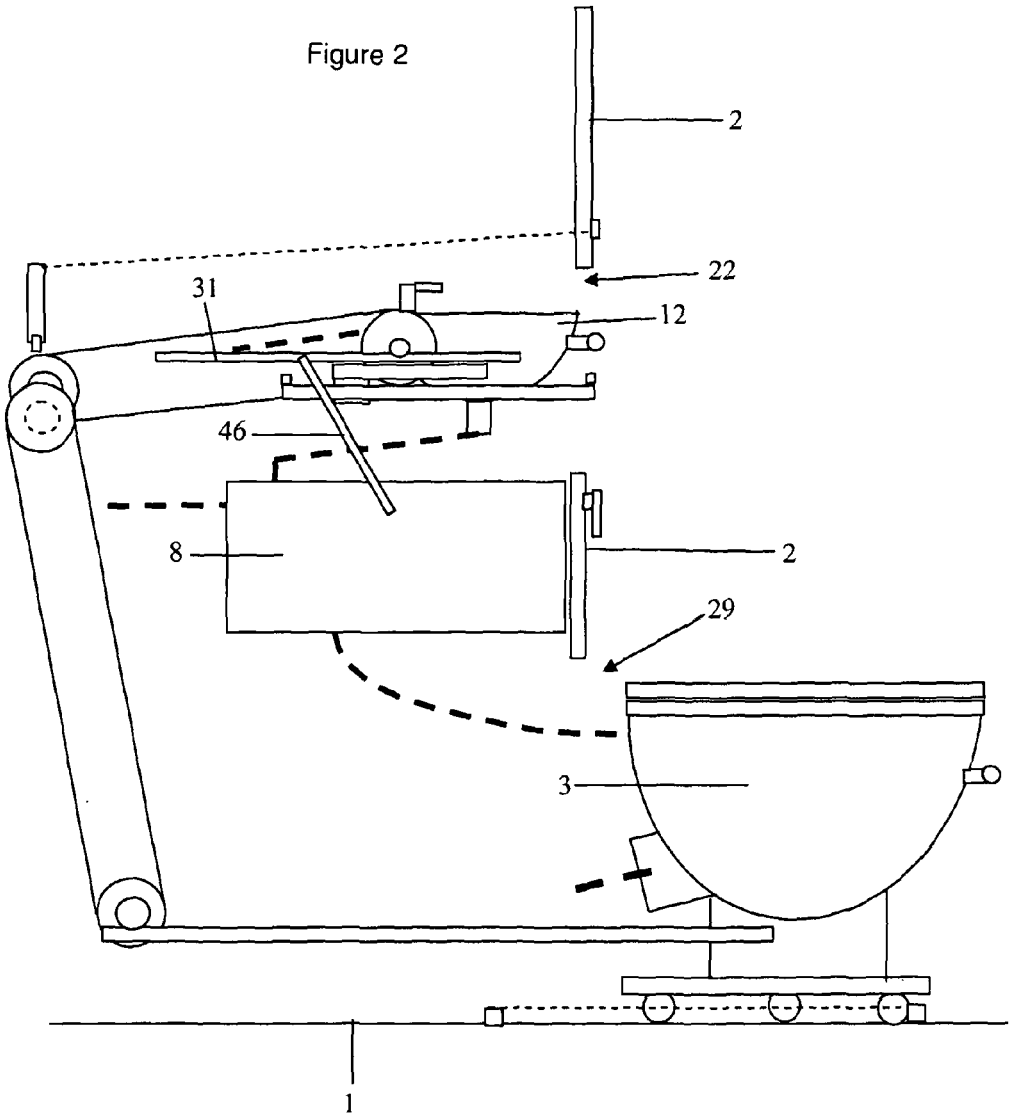
FIG. 2 is a diagrammatic side view of the sanitary installation of FIG. 1, with the wash basin retracted.

Accordingly, from the position in FIG. 1, if handle 23 is pushed the toilet bowl 12 will be retracted through the opening 22. As this happens, rack 31 moves to the left and drives pinion 32 in a clockwise direction. This results in fourth pinion 41 rotating in anti clockwise direction, driving second rack 42 to the right. The toilet bowl 3 is thus extended through the opening 29, until the toilet bowl is fully extended and the wash basin is fully retracted. This position is shown in FIG. 2. From this position, if the wash basin is pulled out or the toilet bowl is pushed back, the above operation works in reverse.

A latch mechanism 43 is provided to lock second toothed wheel 35, and this is controlled via a cable 44 and an operating button 45. When the lock is engaged, neither the wash basin nor the toilet bowl can be moved. The arrangement may be such that whenever either the wash basin or the toilet bowl is in its fully extended position, the latch is engaged automatically and must be released using the button 45, before the configuration can be changed.

In FIG. 2 there is shown an optional addition. A lever 46 is pivotally connected at one end to the operating arm 31 and at the other end to a flush mechanism (not shown) of the cistern 8. As the washbasin 12 is moved forwards after the toilet has been used, not only does the toilet 3 retract, but the lever 46 pivots so that the toilet is flushed.

Figure 3:
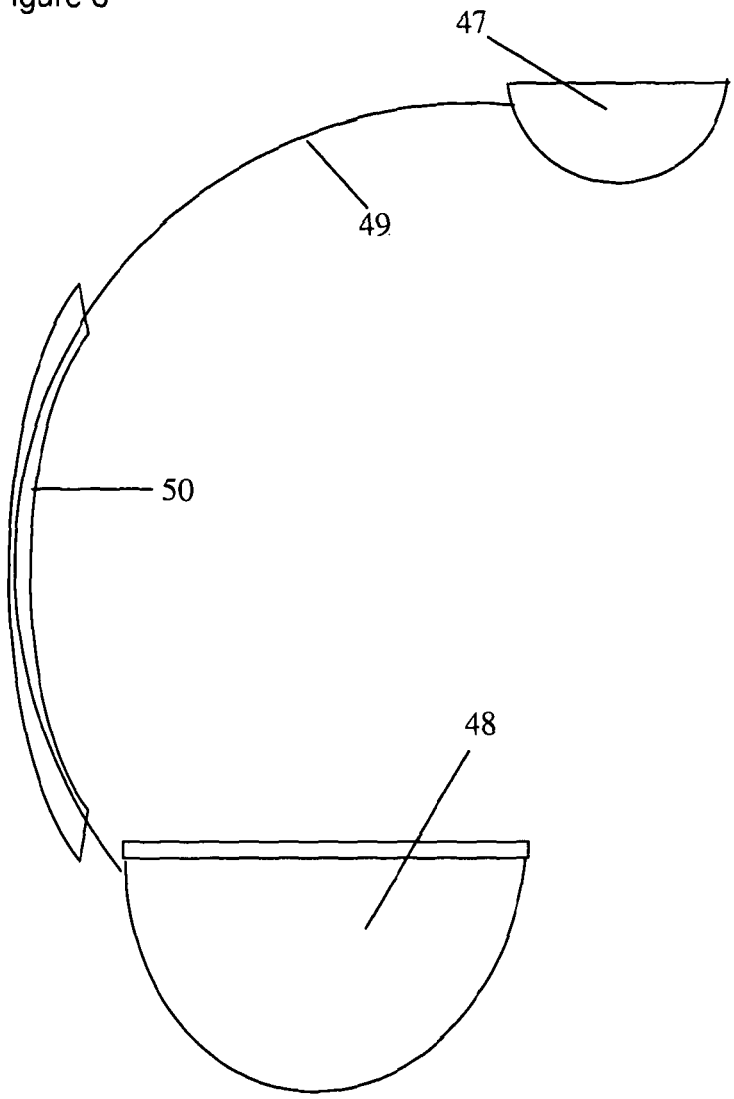
FIG. 3 is a diagrammatic view of an alternative mechanism interconnecting the wash basin and toilet.

FIG. 3 shows, in a diagrammatic form an alternative manner of interconnecting a wash basin 47 and a toilet 48. The two are connected by a flexible element 49 which can transmit compressive forces, such as a strip of steel. This passes through a tubular guide 50 for part of its path. As the basin 47 is pulled out the toilet 48 will retract, and as the basin is pushed back the element 49 transmits force to the toilet to urge it forwards. The system shown is only diagrammatic to explain the principles involved.

Figure 4:
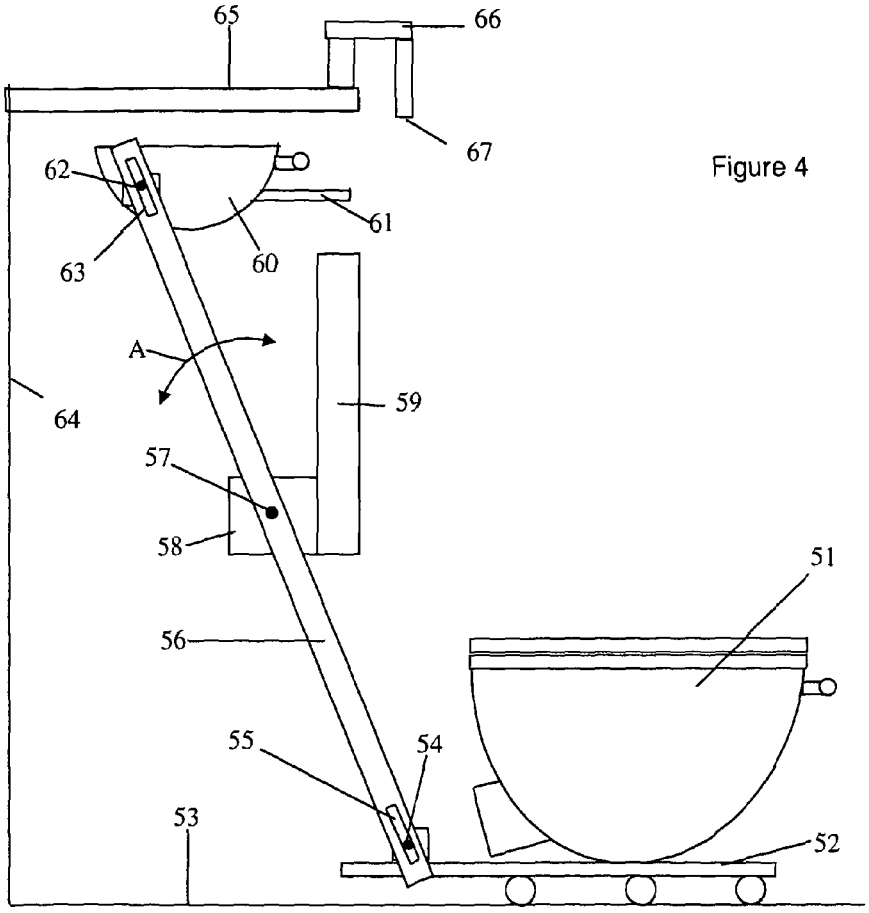
FIG. 4 is a diagrammatic view of an alternative arrangement in accordance with the invention.

In FIG. 4, unit includes a toilet 51 is mounted on a movable support 52 which can roll over a floor 53 so that the toilet can move forwards and backwards. A pivot pin 54 is mounted on the support and is engaged in a slot 55 at one end of a lever 56. The lever is pivoted at 57 to a support 58, which in this case is attached to a wall 59 of the unit, and can pivot in the direction of the arrows A. A wash basin 60 is mounted on a slide 61 sp that it can slide forwards and backwards. A pivot pin 62 is mounted on the basin and is engaged in a second slot 63, at the other end of the lever 56. Thus as the basin moves forwards, the lever pivots and urges the toilet backwards, and vice versa. The unit includes a rear wall 64 and a top cover 65. A tap 66 is mounted on the top cover so that when the basin 60 is in the forward position, the tap outlet 67 is positioned over the basin.

Figure 5:
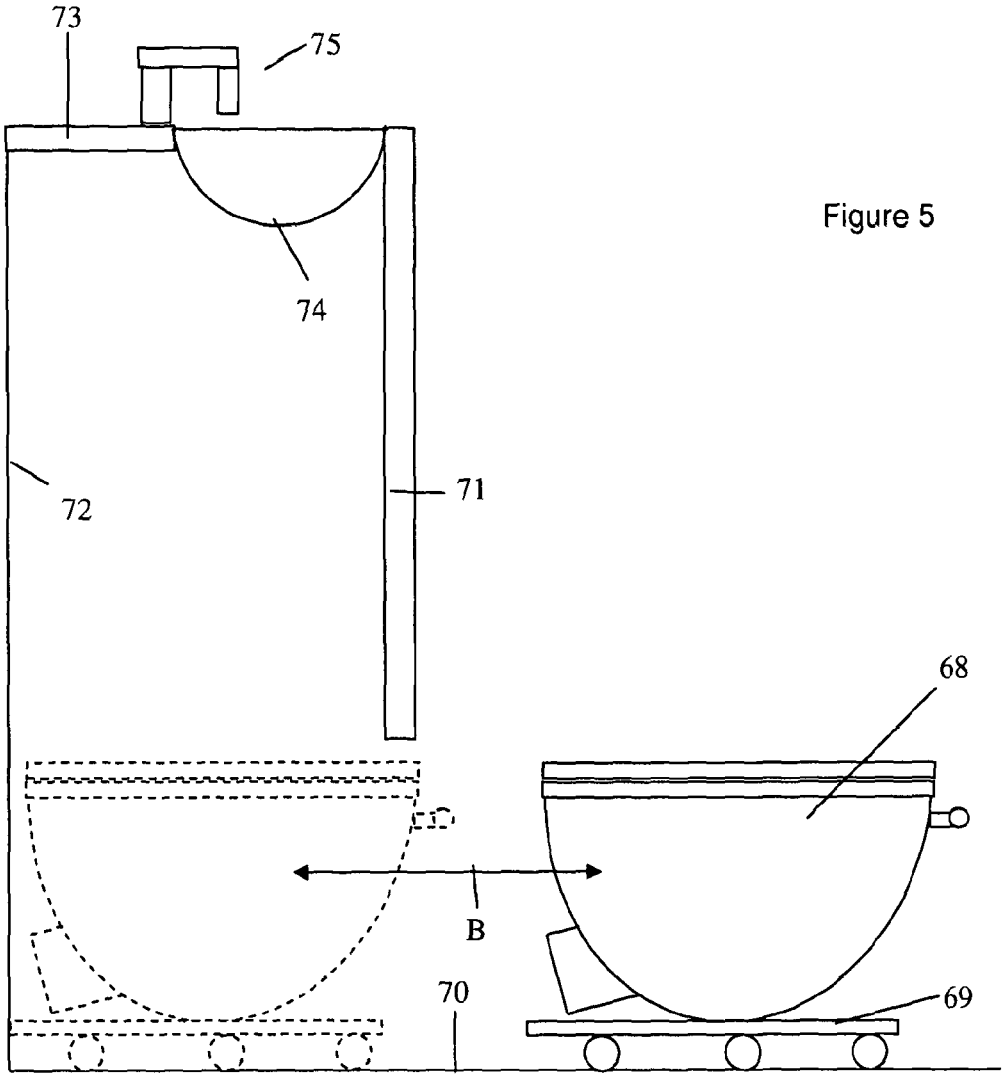
FIG. 5 is a further alternative arrangement in accordance with an aspect of the invention.

FIG. 5 shows an alternative arrangement. In this a toilet bowl 68 is mounted on a support 69 with rollers so that it can move over a floor 70 in the direction of the arrow B, between a retracted position shown in dotted lines and a forward position for use. In the retracted position, the toilet bowl is within a cabinet having a front wall 71, a rear wall 72 and a top 73. Set into the top is a wash basin 74 provided with a tap 75.

In all of the above embodiments, the toilet bowl has a front and a rear and there is a vertical plane passing through that front and rear and also through part of the wash basin, which is mounted higher than the toilet bowl. The movement of the wash basin and/or toilet bowl is along a horizontal which is in that plane or is parallel to a horizontal line in that plane. Details of plumbing has not been shown as that is conventional, with the exception of the use of flexible pipes where necessary.

It will be appreciated that the embodiments of the invention described above are to explain the principles of the invention. Many alternatives and variations may be used in the implementation of the invention. The features of the individual embodiments described may be combined in any workable combination.

The invention claimed is:

1. A sanitary unit comprising:

a toilet having a bowl provided with a seat portion, the toilet bowl having a front and a rear;

a wash basin supported at a level higher than that of the toilet bowl, the wash basin being mounted for sliding movement horizontally, parallel to a line extending through the front and rear of the toilet bowl, between a retracted position in which there is access to the toilet bowl, and a forward position in which the wash basin is to be used;

a cistern for supplying water to flush the toilet bowl; and a mechanism is arranged to flush the toilet automatically when the wash basin is moved from its retracted position to its forward position.

2. The sanitary unit of claim 1, wherein the toilet bowl is mounted for sliding movement horizontally, parallel to the line extending through the front and rear of the toilet bowl, between a retracted position and a forward position in which the toilet bowl is to be used.

3. The sanitary unit of claim 2, wherein the wash basin and the toilet bowl are inter-linked such that movement of the wash basin away from its retracted position is accompanied automatically by movement of the toilet bowl towards its retracted position, and such that movement of the wash basin towards its retracted position is accompanied automatically by movement of the toilet bowl away from its retracted position.

4. The sanitary unit of claim 3, wherein the wash basin and/or toilet bowl are provided with a handle with which a user can effect movement manually of one of the wash basin or toilet bowl, the other of the wash basin and toilet bowl moving simultaneously and automatically.

5. The sanitary unit of claim 1, wherein a waste water outlet of the wash basin is connected to the cistern to provide water for flushing the toilet.

6. A sanitary unit comprising:

a toilet having a bowl provided with a seat portion, the toilet bowl having a front and a rear; and a wash basin supported at a level higher than that of the toilet bowl, there being a vertical plane which passes through the front and rear of the toilet bowl and which also passes through the wash basin, the wash basin being mounted for sliding movement horizontally, parallel to a horizontal line lying in said vertical plane, between a retracted position in which there is access to the toilet bowl, and a forward position in which the wash basin is to be used; wherein the toilet bowl is mounted for sliding movement horizontally, along said horizontal line, between a retracted position and a forward position in which the toilet bowl is to be used and a linkage interconnects the wash basin and the toilet bowl such that movement of one of the wash basin and the toilet bowl away from its retracted position is accompanied automatically by movement of the other of the wash basin and the toilet bowl towards its retracted position.

7. The sanitary unit of claim 6, wherein the wash basin and/or toilet bowl are provided with a handle with which a user can effect movement manually of one of the wash basin or toilet bowl, the other of the wash basin and toilet bowl moving simultaneously and automatically.

8. The sanitary unit of claim 6, further comprising:

a cistern for supplying water to flush the toilet bowl; and a mechanism arranged to flush the toilet automatically when the wash basin is moved from its retracted position to its forward position.

9. The sanitary unit of claim 8, wherein a waste water outlet of the wash basin is connected to the cistern to provide water for flushing the toilet.

10. The sanitary unit of claim 1, wherein there is a vertical plane which passes through the front and rear of the toilet bowl and which also passes through the wash basin, and said line extending through the front and rear of the toilet bowl lies in said vertical plane.

* * * * *